United States Patent [19]

Post

[11] Patent Number: 4,569,179

[45] Date of Patent: Feb. 11, 1986

[54] BRICKLAYER'S SPEED LEAD WITH REVERSIBLE CLIP MEANS

[76] Inventor: Marvin W. Post, 2858 Highway 13, Eagan, Minn. 55121

[21] Appl. No.: 729,484

[22] Filed: May 1, 1985

[51] Int. Cl.[4] ..... B43L 13/00; E04G 21/18

[52] U.S. Cl. ..... 52/747; 33/408; 33/410

[58] Field of Search ..... 52/747, 749; 33/404–410

[56] References Cited

U.S. PATENT DOCUMENTS

| | | | |
|---|---|---|---|
| 987,424 | 3/1911 | Bethel | 33/410 |
| 1,878,448 | 9/1932 | Cornuelle | 33/408 X |
| 2,685,741 | 8/1954 | Wilkinson | 33/410 X |
| 3,039,196 | 6/1962 | Jernigan | 33/410 X |
| 3,349,494 | 10/1967 | Blake | 33/410 |
| 4,023,360 | 4/1889 | Smith | 33/410 |
| 4,057,903 | 11/1977 | Cantera | 33/406 |

FOREIGN PATENT DOCUMENTS

| | | | |
|---|---|---|---|
| 2514808 | 4/1983 | France | 52/747 |
| 975976 | 11/1982 | U.S.S.R. | 52/747 |

*Primary Examiner*—J. Karl Bell

*Attorney, Agent, or Firm*—Thomas B. Tate

[57] ABSTRACT

The invention is a speed lead for use in laying bricks, comprising a main L-shaped structure having side structures attached perpendicularly to either end of the main structure so as to define a generally rectangular opening, and reversible clips adjustably mounted on the side structures and having projections around which a mason's plumb line can be strung.

4 Claims, 3 Drawing Figures

BRICKLAYER'S SPEED LEAD WITH REVERSIBLE CLIP MEANS

SUMMARY AND BACKGROUND OF THE INVENTION

Speed leads are used in the construction industry to speed up the building of brick corners, instead of using a level to keep the corners plumb.

For many years bricklayers have used various devices to build faster leads, for example, wooden two-by-fours or metal devices fastened to the building and having a line stretched from corner to corner, secured to the lead by a wooden or plastic block. The brick is then laid to the line using the two-by-four or metal lead to keep the brick plumb on the corner. Frequently these line blocks are kicked or knocked off the speed lead, thus becoming a projectile which can strike a bricklayer and cause serious injury. Using conventional types of speed leads also makes it difficult to lay the corner bricks level, because the mud used to lay the brick tends to become squashed between the brick and the speed lead. As a result, the brick is either held up or pushed away from the lead, causing it to be out of plumb and smearing the end of the brick with mud, which is unsightly.

The object of the present invention is to eliminate these drawbacks and provide a speed lead which will enable bricklayers to lay a plumb, level corner faster, safer, neater, and more accurately than is possible with devices currently known in the industry. With my new speed lead, it is nearly impossible to accidentally kick or knock off the clip on the lead, because of the torque on the clip. When laying brick to my new speed lead, the bricks are laid into the lead and held in place by two pieces of strap metal which have their edges placed at right angles to each other. Because the narrow edges of the metal hold the brick in place, the mud between the bricks can be easily forced out and allowed to hang out or drop off. This enables the bricklayer to easily see almost the entire brick and mud joint, thus assuring a neat, plumb, and level brick job.

DESCRIPTION OF THE PREFERRED EMBODIMENT OF THE INVENTION

Figure 1:
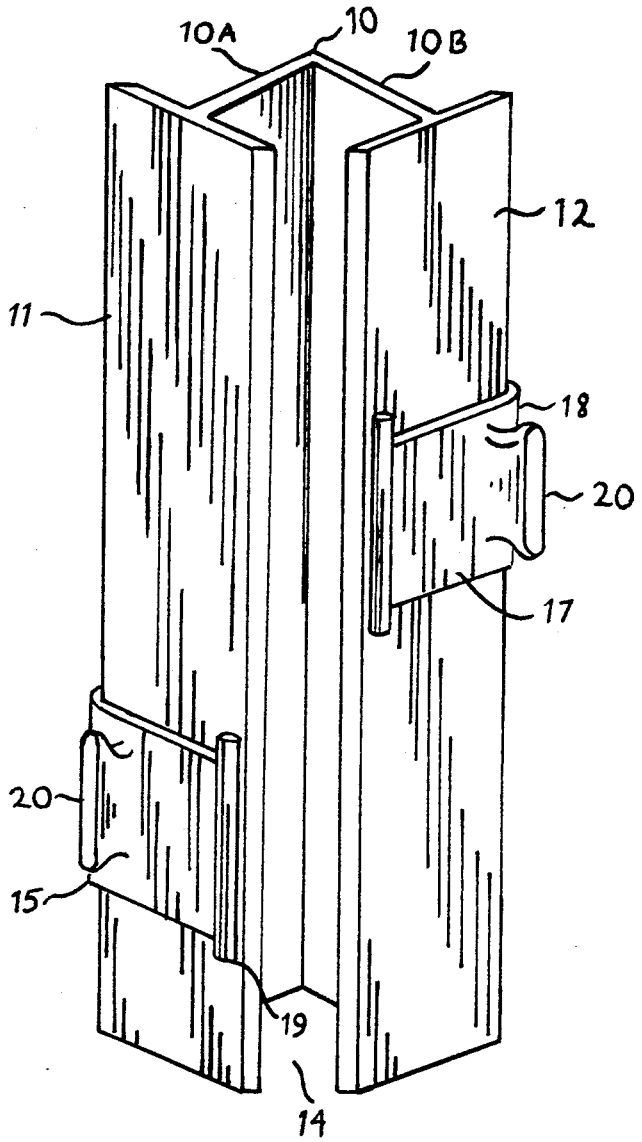
FIG. 1 is a front view.
Figure 2:
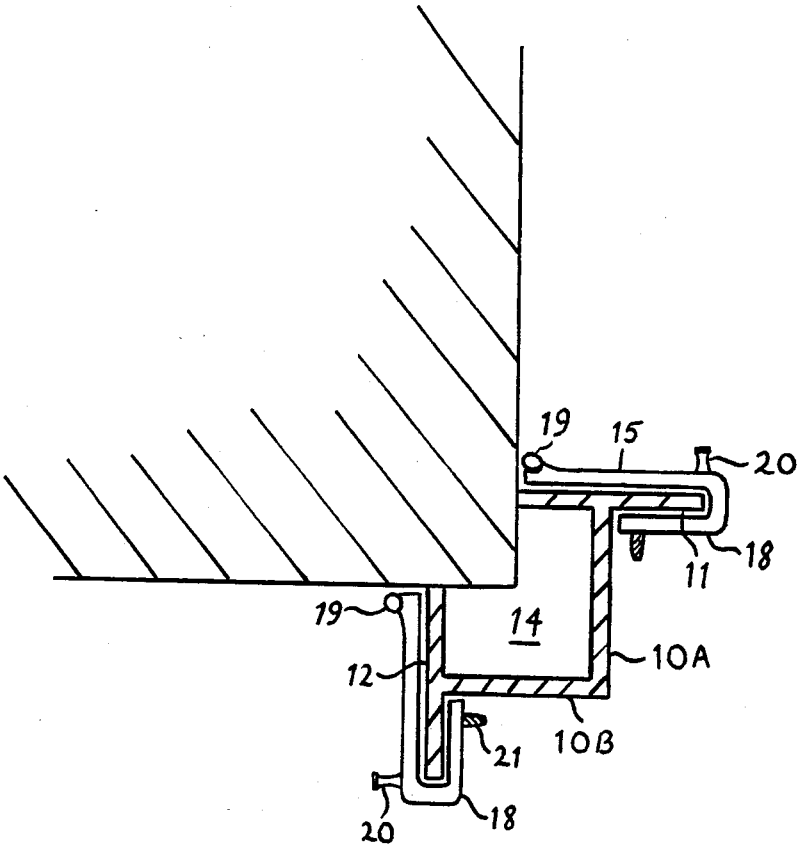
FIG. 2 is a top view of the device as used on an outside corner.
Figure 3:
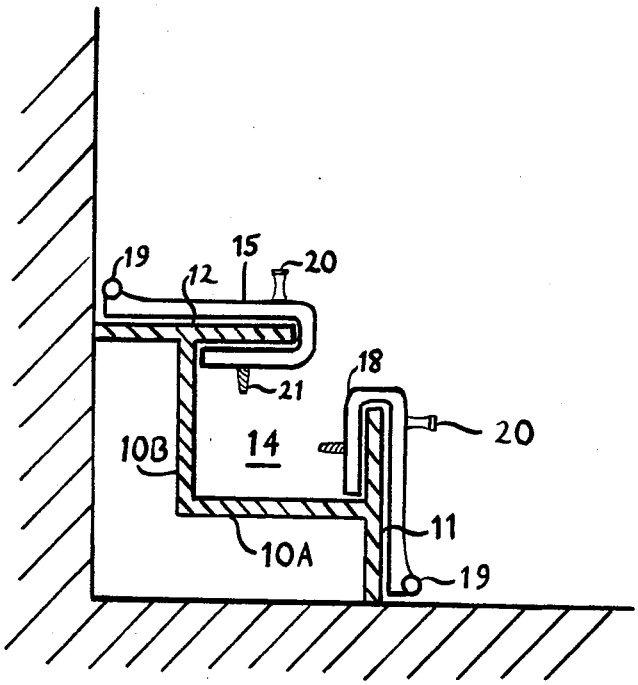
FIG. 3 is a top view of the device as used on an inside corner.

The invention is a speed lead with reversible clip means, said device being usable for laying bricks such that the corners of a brick wall will be plumb and level.

The speed lead is formed of extruded metal, preferably aluminum, and can be made in different lengths. The speed lead comprises a main right-angled piece 10, wherein sides 10A and 10B meet to form said right angle, side 11 formed perpendicularly to side 10A and side 12 formed perpendicularly to side 10B. Sides 10A, 10B, 11, and 12 define a generally rectangular slot 14. When the speed lead is used on an outside corner of a brick wall, the corner bricks fit into slot 14 and are held between sides 11 and 12. When the speed lead is used on an inside corner of a brick wall, the edges of sides 11 and 12 which are distal to slot 14 rest against the corner bricks.

Each clip 15 is formed as a unit, preferably of plastic, is generally U-shaped, and comprises a main body portion 17 which forms a lip 18, a line-holding stem 19 formed to the body 17 at the end opposite the lip 18, and plumb-line mounting projection 20 at the end of the body 17 adjacent to the lip 18. The clip 15 can optionally be provided with a Vlier pin 21 on its underside. When the Vlier pin 21 is present, its function is to prevent the clip from falling to the ground when there is no torque or line pressure on the clip.

The clips 15 are placed onto the speed lead so that the lip 18 of each clip 15 fits around the edges of sides 11 and 12, respectively. When the speed lead is used on an outside corner, the clips 15 are placed so that the lip 18 of each clip 15 fits around the outside edges of sides 11 and 12, respectively. When the speed lead is used on an inside corner, the clips 15 are reversed. The lips 18 fit around the inside edges of sides 11 and 12, respectively. On either inside or outside corners, the stem 19 is at the end of the clip 15 adjacent to the brick line.

The mason's plumb line is wrapped around the projections 20 and the stems 19 of clips 15. The line then follows the brick wall on either side. With this speed lead and reversible clip means, a bricklayer can lay the bricks plumb, in a straight line, to make a perfect corner. As each row of bricks is laid, the clips 15 are moved up the speed lead one course and locked into position so that the laying of the next course of bricks can proceed.

My invention can be used in conjunction with conventional elements, not shown, in laying a brick corner. For example, the speed lead is held to the building by means of brackets which fit into a coupling held onto the speed lead by means of a bolt and wing nut. The main tube of the coupling has a moveable sleeve fitted over it, said sleeve being held on by a thumb nut. The main tube also has a tightener which threads through a nut. Because the smaller rectangular pipe has a swivel coupling, the speed lead does not have to be taken off during breaks. To prevent the brick from pulling away from the speed lead on inside corners, the thumbscrew on the rod-like adjustable bracket can be pushed in until the bracket holds the speed lead securely. This rod-like bracket fits into the clip 15 and can be slid out to be moved.

I claim:

1. A speed lead for use in laying bricks, said device comprising:

a main, generally L-shaped, piece comprising two sides formed at right angles to each other;

a first generally rectangular side piece formed perpendicularly to the edge of one of said sides of said main piece;

a second generally rectangular side piece formed perpendicularly to the edge of the other of said sides of said main piece;

said first side piece and said second side piece being aligned at right angles to each other and defining a generally rectangular opening between said first side piece and said second side piece;

clip means adjustably and reversibly mounted on each of said side pieces.

2. The invention of claim 1 wherein each of said clip means comprises a main body portion which forms a curved lip at one end, projection means for mounting a mason's plumb line, said projection means being formed at the end of said main body portion proximal to said lip, and stem means for mounting a mason's plumb line, said stem means being formed at the end of said main body portion distal to said lip.

3. The invention of claim 2 wherein the device is adapted for use on an outside brick corner, wherein said rectangular opening between said first and second side pieces receives the corner bricks, and wherein said clips are mounted on said speed lead so that said lip of one of said clips clamps the outside edge of said first side piece, and said lip of the other of said clips clamps the outside edge of said second side piece.

4. The invention of claim 2 wherein the device is adapted for use on an inside brick corner, wherein the edges of said first and second side pieces which are distal to said rectangular opening between said first and second side pieces rest against the corner bricks, and wherein said clips are mounted on said speed lead so that said lip of one of said clips clamps the inside edge of said first side piece, and said lip of the other of said clips clamps the inside edge of said second side piece.

* * * * *